US009472129B2

(12) United States Patent
Liu

(10) Patent No.: US 9,472,129 B2
(45) Date of Patent: Oct. 18, 2016

(54) AUTOMATICALLY FOLDED LED DISPLAY SCREEN AND APPLICATION METHOD

(71) Applicant: Yanping Liu, Guangdong (CN)

(72) Inventor: Yanping Liu, Guangdong (CN)

( * ) Notice: Subject to any disclaimer, the term of this patent is extended or adjusted under 35 U.S.C. 154(b) by 71 days.

(21) Appl. No.: 14/478,748

(22) Filed: Sep. 5, 2014

(65) Prior Publication Data

US 2015/0117009 A1 Apr. 30, 2015

(30) Foreign Application Priority Data

Oct. 25, 2013 (CN) ..... 2013 1 0510117

(51) Int. Cl.

| | |
|---|---|
| ***F21V 21/00*** | (2006.01) |
| ***G09F 15/00*** | (2006.01) |
| ***G09F 9/30*** | (2006.01) |
| ***G09F 9/33*** | (2006.01) |

(52) U.S. Cl.

CPC ..... *G09F 15/0062* (2013.01); *G09F 9/301* (2013.01); *G09F 9/33* (2013.01)

(58) Field of Classification Search

CPC ..... F21Y 2101/02; F21V 21/30; G09F 15/0062; G09F 9/301; G09F 9/33

USPC ..... 362/249.09

See application file for complete search history.

(56) References Cited

U.S. PATENT DOCUMENTS

| | | | | |
|---|---|---|---|---|
| 7,825,325 | B2 * | 11/2010 | Kennedy | F21L 4/00 136/244 |
| 8,662,705 | B2 * | 3/2014 | Roberts | A61L 2/10 362/249.02 |
| 2013/0271940 | A1 * | 10/2013 | Cope | H05K 7/14 361/809 |

* cited by examiner

*Primary Examiner* — Andrew Coughlin
*Assistant Examiner* — Meghan Ulanday
(74) *Attorney, Agent, or Firm* — Tim Tingkang Xia, Esq.; Locke Lord LLP

(57) ABSTRACT

The present invention disclosed an automatically folded LED display screen and application method. The automatically folded LED display screen includes LED sub-displays hinged to each other, of which the LED sub-displays arranged at the top are provided with a fixture, with motors and winding reels, and the LED sub-displays screen arranged at the bottom are connected to a tray. The said winding reel is wound with steel wires, which are connected to the tray. The display screen can be automatically folded and unfolded, very easy to use.

5 Claims, 4 Drawing Sheets

AUTOMATICALLY FOLDED LED DISPLAY SCREEN AND APPLICATION METHOD

CROSS-REFERENCE TO RELATED APPLICATIONS

This non-provisional application claims priority under 35 U.S.C. §119(a) on Patent Application No(s). 201310510117.X filed in P.R. China on Oct. 25, 2013, the entire contents of which are hereby incorporated by reference.

TECHNICAL FIELD

The present invention relates to a semiconductor display device, and in particular, to a LED display screen that can be automatically folded.

BACKGROUND ART

LED display screen, featured by high brightness, good dynamic video display, low energy consumption, long service life, has been widely used. The splicing of the existing LED screen is fixed, which cannot be folded. When applied to the building's exterior walls, the LED display screen will occupy a large area of external wall and affect the interior lighting. When used in the stage and evening party, the existing LED display cannot achieve a wonderful artistic effect since it is a fixed flat panel display.

SUMMARY OF THE INVENTION

In order to resolve the existing problems in the prior arts, the present invention provides an automatically folded LED display screen.

The present invention provides an automatically folded LED display screen, consisting of a plurality of LED sub-displays arranged in matrix manner, a fixture arranged on the top of LED display screen, wherein said LED sub-displays are hinged to each other along longitudinally, a motor and a winding reel are arranged at the both sides on the top of the fixture, and said LED display screen at the bottom is connected to a tray, said winding reel is wound with steel wires, which are connected to the tray.

In one embodiment, two groups of motors and winding reel groups are provided, corresponding to front and rear sides of the tray. The bottom of LED display screen is connected to the tray by a hinge.

In another embodiment, the back sides of the said sub-display are connected in pairs longitudinally through a rigid connecting member.

The present invention also discloses an application method of the automatically-folded LED display screen, including the automatic folding and automatic unfolding steps of LED display screen.

The automatic folding steps of the LED display screen are described as follows. Firstly, start the motor to make the tray in a horizontal position and ensure that the center of gravity of the LED display screen at the unfolding state is located at the center of the tray; continue to run the motor and the winding reel winds the steel wires to drive the tray to move up smoothly. The sub-displays of LED display screen are automatically forward folded once, and folded back again in sequence under the action of the tray's ascending, and then folded neatly together once and again; finally, the LED display screen folding is completed and the motor stops running.

The automatic unfolding steps of LED display are described as follows. Firstly, start the motor and winding reel to make the tray in a horizontal position and descend smoothly, and LED display screen will automatically unfold under the action of gravity when the tray descends; then, when the display screen is unfolded completely, the motor stops running and the tray stops descending and maintains at the horizontal position; finally, re-start the motor at the rear of the tray, so that the tray rotates to the back of LED display screen with the axis of bottom of LED display, until the tray is at the vertical position.

The device disclosed in the invention is ingenious and low in manufacturing cost. The LED display can realize automatic folding in a single-row or dual-row folding way. When not in use, the LED display screen does not affect the daylighting of the building; moreover, no dusts are accumulated on the LED display screen surface after folding, which can ensure that the display screen is clean.

BRIEF DESCRIPTION OF THE DRAWINGS

The various objects and advantages of the present invention will be more readily understood from the following detailed description when read in conjunction with the appended drawing.

DETAILED DESCRIPTIONS OF THE PREFERRED EMBODIMENTS

Figure 1:
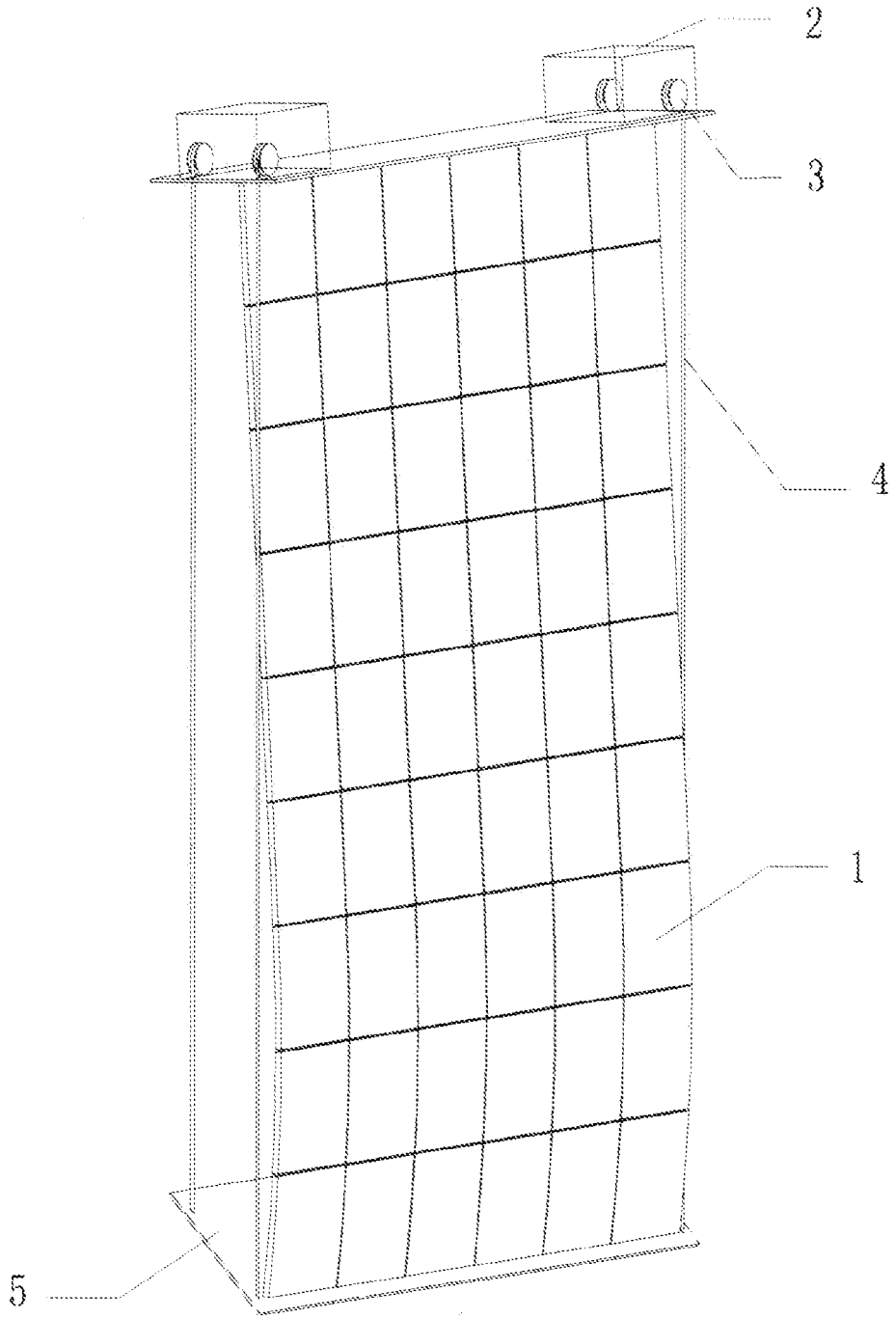
FIG. 1 is a schematic view showing the unfolding of the display.
Figure 2:
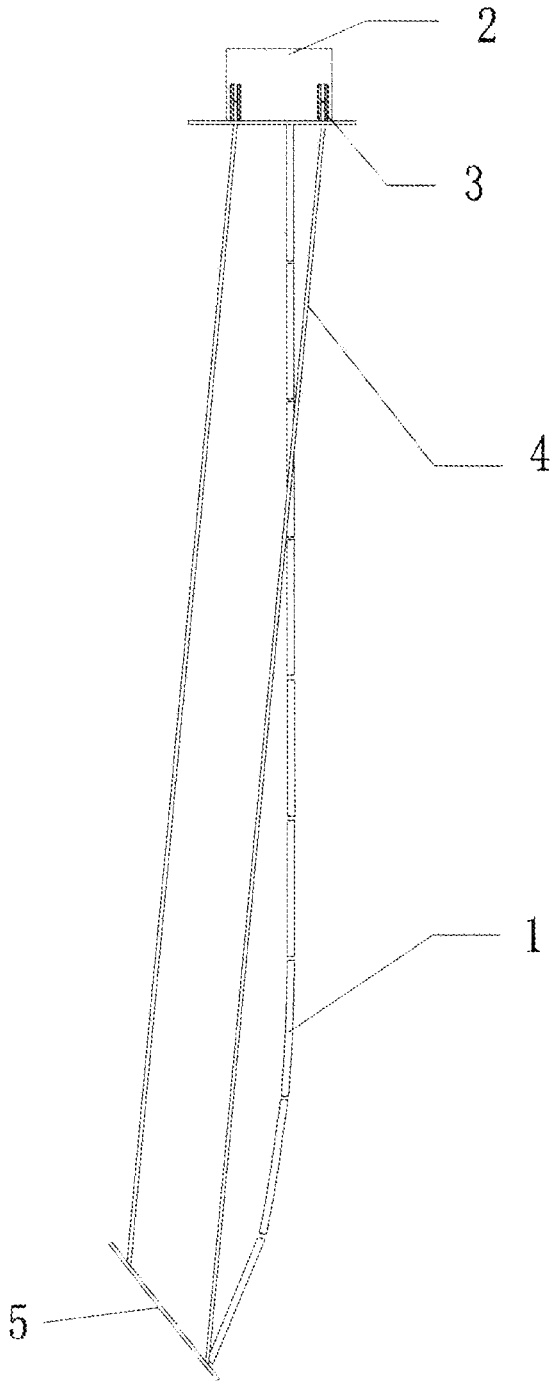
FIG. 2 is a side view of FIG. 1.
Figure 3:
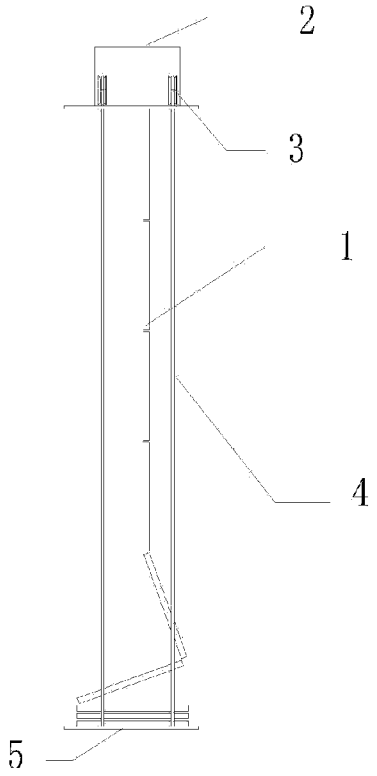
FIG. 3 is a schematic diagram showing the folding process.
Figure 4:
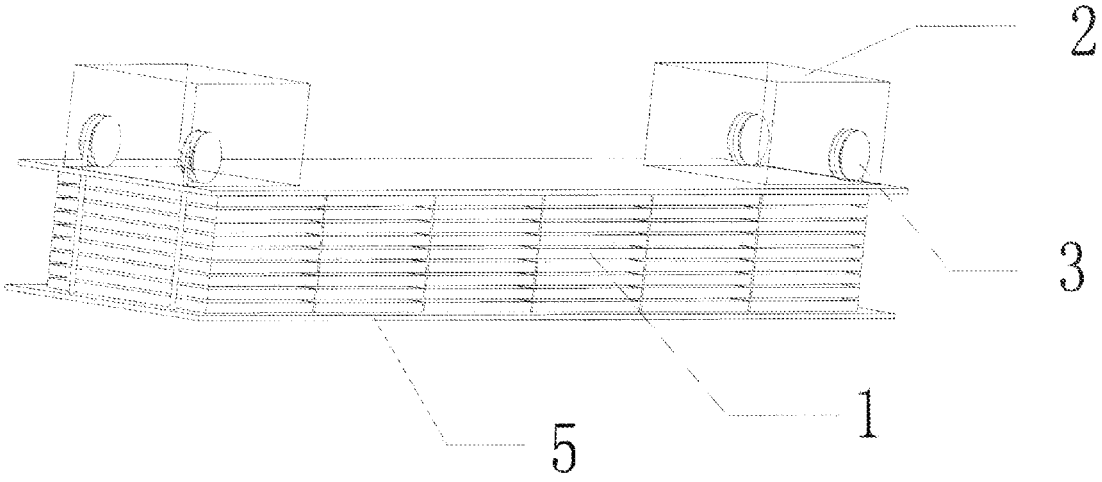
FIG. 4 is a schematic view showing fully folded.

As shown in FIG. 1-FIG. 4, the automatically-folded LED display screen in one embodiment includes a plurality of LED sub-display screens 1 in a matrix arrangement manner. Each LED sub-display screen is hinged with the adjacent LED sub-display screen on the same row along the longitudinal direction, making the LED sub-display screen folded row by row, easy to carry, transport or storage.

In the above embodiment, the LED sub-display screen at the top are provided with fixture, such as fixing plate 6, on the surfaces of both sides of which are provided with motor 2 and winding reel 3. The LED sub-display screens at the bottom are connected with a tray 5. The winding reel 3 is wounded with steel wire 4 which is connected to tray 5. The LED sub-display screens at the bottom are connected with the said tray through hinges at the rear, so that the tray can rotate around the edge of LED sub-display screen at the bottom, and the screen will not be blocked when unfolding, ensuring a better viewing effect.

In order to achieve the purpose of tray 5 turn, on front and back sides of the fixing plate 6 are provided with two groups of motors and winding reels respectively. Each group of motor and winding reel is connected with tray 5 through steel wire 4. By driving the motor and winding reel at the rear side, the variation of length of the steel wire at the rear side is greater than that of the front side, so that the tray 5 can rotate around the edge of the LED display screen at the bottom automatically. When the LED display screen is unfolded, the tray automatically turns to the rear of the display screen without manual operation, which is very convenient. Certainly, four groups of motors and winding reels can be arranged, which can be connected to the four corners of the tray respectively.

In another embodiment, the sub-display screens are connected along the longitudinal direction through rigid connecting members in pairs at the back side, and folded every two rows instead of every one row. Certainly, the width of tray will be widened accordingly. In addition, modification to the folding way of every 3 rows within the field is also within the scope of the present invention.

Figure 5:
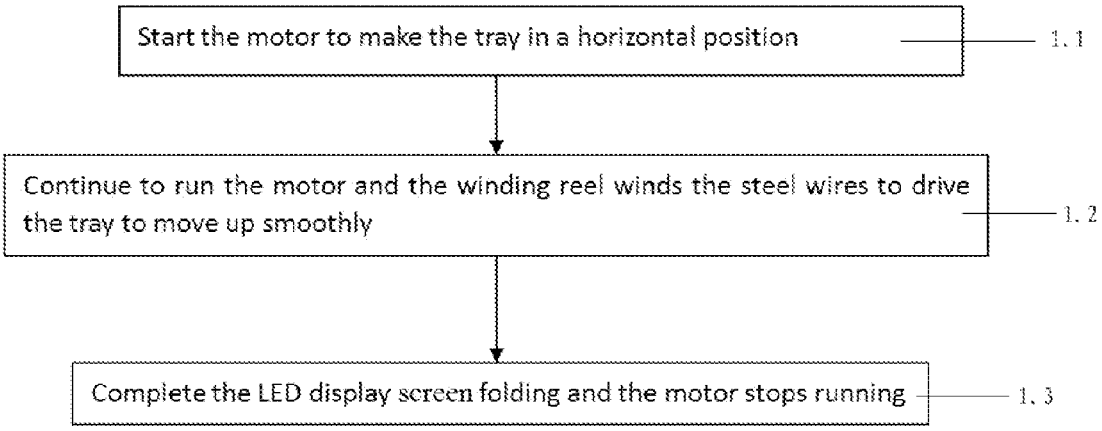
FIG. 5 shows the flowchart of folding steps.

As illustrated in FIG. 5, the automatic folding steps provided in one embodiment comprising:

Step 1.1 Initially the tray is in a vertical state and hidden at the rear of the display screen, which will not affect the effect of the display. Start the motor to make the tray in a horizontal position and the LED display screen is in an unfolding state, ensuring that the center of gravity of the LED display screen is located at the center of the tray;

Step 1.2 Continue to run the motor and the winding reel winds the steel wires to drive the tray to move up smoothly. The sub-unit of LED display screen is automatically folded forward once, and folded back again under the action of gravity, and then folded back once in sequence, and then once and again, folded neatly together;

Step 1.3 Until each row of sub-display screen is folded, the LED display screen folding is completed and the motor stops running.

Figure 6:
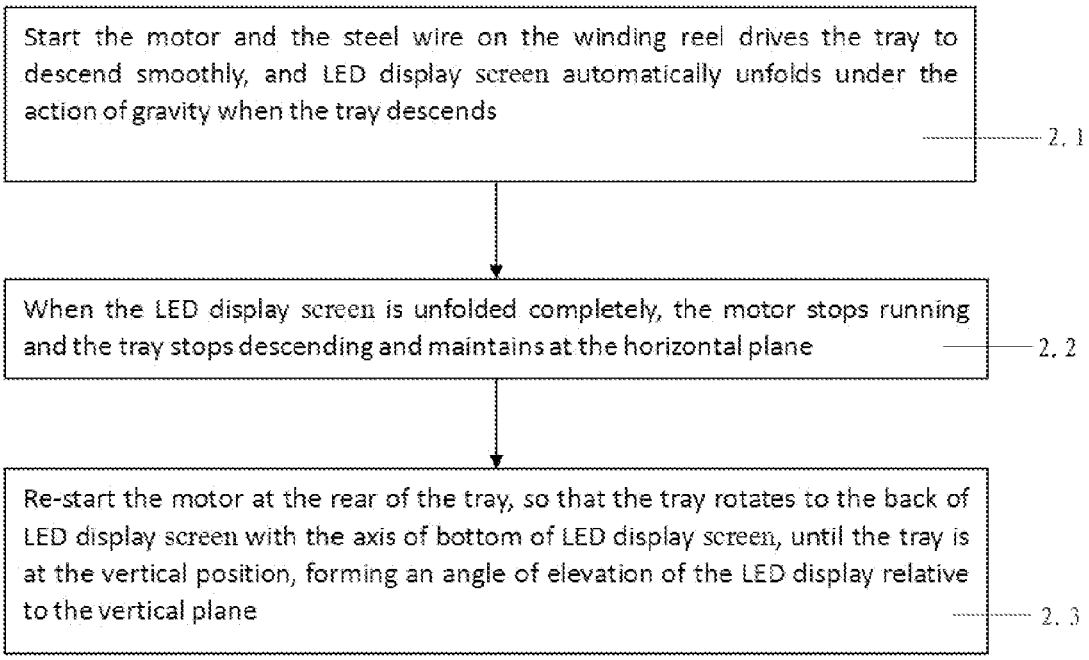
FIG. 6 shows the flowchart of unfolding steps.

As illustrated in FIG. 6, the automatic unfolding steps of LED display screen are described as follows:

Step 2.1 Start the motor and descend the steel wires on the winding reel, to make the tray descending steadily, and LED display screen will automatically unfold under the action of gravity when the tray descends;

Step 2.2 When the LED display screen is unfolded completely, the motor stops running and the tray stops descending and maintains at the horizontal position;

Step 2.3 Re-start the motor at the rear of the fixture, so that the tray rotates to the back of LED display screen with the axis of bottom of LED display screen, until the tray is at the vertical position, forming an angle of elevation of the LED display screen relative to the vertical plane, enlarging the viewing angle and showing better effect.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An automatically folded LED display screen, consists of comprising:

a plurality of LED sub-display screens arranged in a matrix manner, wherein the LED sub-display screens are directly hinged to each other along longitudinally;

a fixture arranged on a top LED sub-display screen of the LED sub-display screens;

two groups of motors and winding reels respectively arranged at two sides of the fixture, wherein the winding reels are wound with steel wires; and a tray connected to a bottom LED sub-display screen of the LED sub-display screens and the steel wires, wherein when the LED display screen is expanded, the tray is in a vertical position and is hidden behind the expanded LED display screen.

2. The automatically folded LED display screen according to claim 1, wherein the two groups of motors and winding reels are provided corresponding to a front side and a back side of the tray.

3. The automatically folded LED display screen according to claim 1, wherein the bottom LED sub-display screen is connected to the tray through a hinge.

4. The automatically folded LED display screen according to claim 1, wherein the back sides of the LED sub-display screens are connected in pairs longitudinally through a rigid connecting member.

5. An application method of an automatically folded LED display screen according to claim 1, including automatic folding and unfolding steps, wherein:

the automatic folding steps include:

step 1.1 starting the motors to make the tray in a horizontal position and ensure that the center of gravity of the LED display screen at an unfolding state is located at the center of the tray;

step 1.2 continuing to run the motors and the winding reels to wind the steel wires to drive the tray to move up smoothly, such that the LED sub-display screens are automatically forward folded once, and folded back again in sequence due to the tray moving up, and then folded neatly together once and again; and step 1.3 when the LED display screen folding is completed, stopping the motors;

the automatic unfolding steps include:

step 2.1 starting the motors and the winding reels to make the tray in the horizontal position and to wind the steel wires to drive the tray to descend smoothly, such that the LED sub-display screens are automatically unfolded due to gravity when the tray descends;

step 2.2 when the LED display screen is unfolded completely, stopping the motors such that the tray stops descending and maintains at the horizontal position; and step 2.3 re starting the motors at the back side of the fixture, so that the tray rotates to the back of LED display screen, until the tray is in the vertical position.

* * * * *